US006745537B1

(12) United States Patent
Hamilton

(10) Patent No.: US 6,745,537 B1
(45) Date of Patent: Jun. 8, 2004

(54) MODULAR WALL OR FENCE CONSTRUCTION SYSTEM

(76) Inventor: Roderick Bruce Hamilton, 110 Siemens Road, Kelowna, British Columbia (CA), V1Z 3S3

( * ) Notice: Subject to any disclaimer, the term of this patent is extended or adjusted under 35 U.S.C. 154(b) by 93 days.

(21) Appl. No.: 10/227,820

(22) Filed: Aug. 27, 2002

(51) Int. Cl.[7] ..... E04B 1/343

(52) U.S. Cl. ..... 52/574; 52/608; 52/604; 52/605; 52/561; 52/566; 52/611; 405/262; 405/284; 405/286; 405/287

(58) Field of Search ..... 52/574, 608, 604, 52/605, 561, 566, 611; 405/262, 284, 286, 287

(56) References Cited

U.S. PATENT DOCUMENTS

| | | | | | |
|---|---|---|---|---|---|
| 722,580 | A | * | 3/1903 | Hill | 404/7 |
| 2,888,779 | A | * | 6/1959 | Hostetter | 47/33 |
| 3,877,236 | A | | 4/1975 | O'Neill et al. | |
| 4,050,254 | A | | 9/1977 | Meheen et al. | |
| 4,825,619 | A | | 5/1989 | Forsberg | |
| 4,884,378 | A | | 12/1989 | Scheiwiller | |
| 4,896,999 | A | | 1/1990 | Ruckstuhl | |
| 4,920,712 | A | | 5/1990 | Dean, Jr. | |
| 4,922,678 | A | | 5/1990 | Scheiwiller | |
| 5,119,587 | A | * | 6/1992 | Waltz | 47/33 |
| 5,133,620 | A | | 7/1992 | Scheiwiller | |
| 5,178,492 | A | | 1/1993 | Meheen | |
| 5,222,342 | A | * | 6/1993 | Defferrari | 405/284 |
| 5,350,256 | A | * | 9/1994 | Hammer | 405/286 |
| 5,409,325 | A | * | 4/1995 | Wu | 404/34 |
| 5,456,555 | A | | 10/1995 | Bokeler | |
| 5,490,363 | A | | 2/1996 | Woolford | |
| 5,556,228 | A | * | 9/1996 | Smith | 405/16 |
| 5,688,078 | A | | 11/1997 | Hammer | |
| 5,704,183 | A | | 1/1998 | Woolford | |
| 5,709,062 | A | | 1/1998 | Woolford | |
| 5,795,105 | A | | 8/1998 | Guth | |
| 6,113,318 | A | | 9/2000 | Guth | |
| 6,394,705 | B1 | * | 5/2002 | Lefebvre | 405/262 |
| 6,615,561 | B2 | * | 9/2003 | MacDonald et al. | 52/606 |
| 6,641,334 | B2 | * | 11/2003 | Woolford | 405/284 |

FOREIGN PATENT DOCUMENTS

| | | |
|---|---|---|
| JP | 11-124866 | 5/1999 |

* cited by examiner

*Primary Examiner*—Carl D. Friedman
*Assistant Examiner*—Steve Varner
(74) *Attorney, Agent, or Firm*—Anthony C. Edwards

(57) ABSTRACT

A modular wall or fence construction system includes at least first and second I-profile blocks, each having an I-shape in planform. The I-shape defines a parallel pair of flanges across opposite ends of a web extending between the flanges. The I-profile blocks have generally planar and parallel upper and lower surfaces and a uniform vertical height. Each of the flanges of the first and second I-profile blocks have radiused rib keys formed in opposite parallel edges of the flanges. The edges are distal on the flanges relative to the web. A first pair of the radiused rib keys are a pair of convex rails along the parallel edges on a first side of the web. A second pair of the radiused rib keys are a pair of concave channels along the parallel edges on a second side of the web opposite the first side of the web. Each flange has oppositely disposed, on opposite edges, one convex rail and one concave channel.

10 Claims, 14 Drawing Sheets

Figure 12
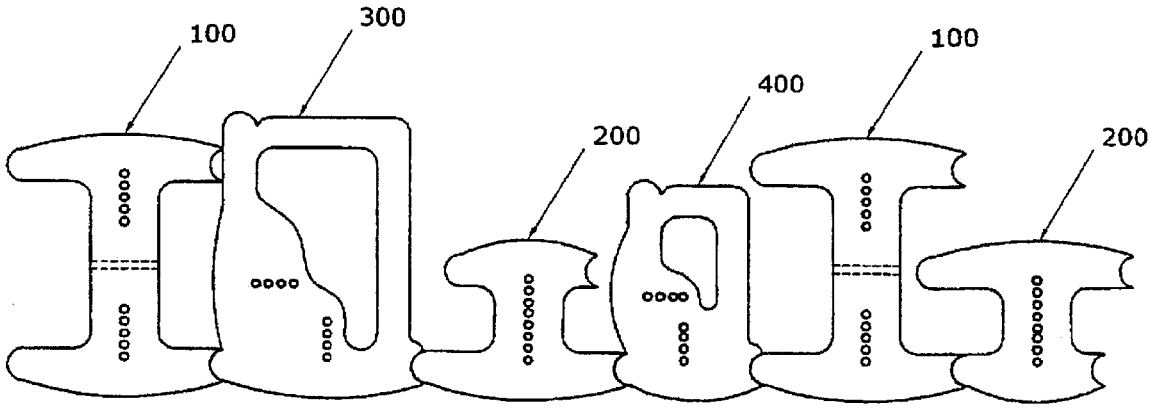
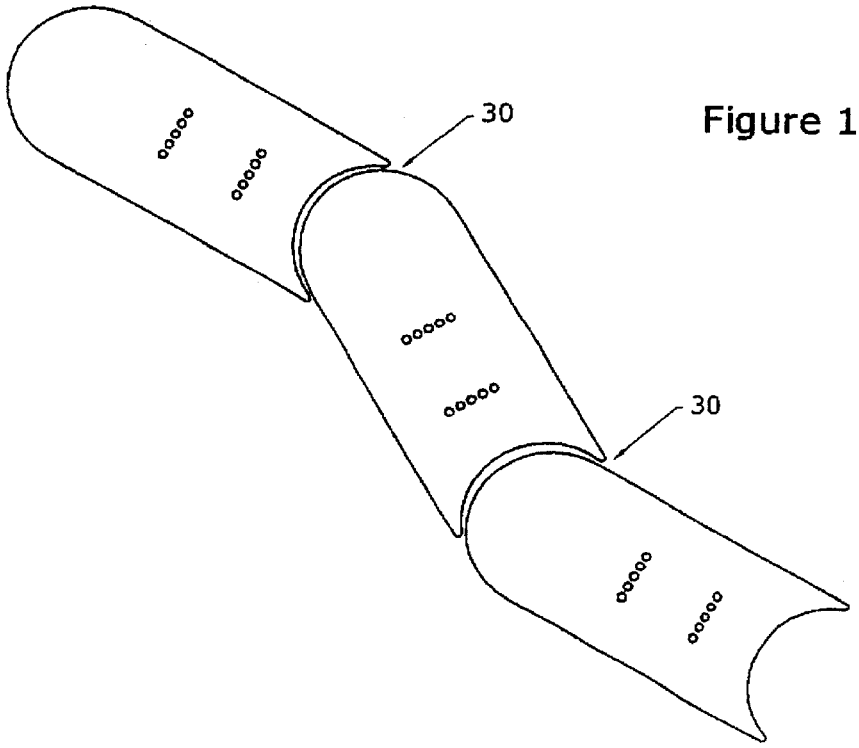
Figure 13

MODULAR WALL OR FENCE CONSTRUCTION SYSTEM

FIELD OF THE INVENTION

This invention relates to the field of modular concrete interlocking blocks for use in gravity retaining walls, sound and privacy fences and for erosion control, and in particular to a modular concrete building block system wherein two basic profiles for the building blocks provide for improved interlocking flexibility.

BACKGROUND OF THE INVENTION

The prior art is replete with interlocking block designs and systems for modularly constructing retaining walls. For example, applicant is aware of the following United States Patents commonly assigned to Anchor Wall System, Inc.: U.S. Pat. Nos. 6,113,318; 5,795,105; 5,709,062; 5,704,183; and 5,490,363 all of which entitled Composite Masonry Block and directed to a masonry block which includes back legs directed outwardly from the blocks back surface, wherein the block is shaped so that the blocks may be stacked to provide an interlocking structure by the protrusions of one block fitting into the insets of another block.

Applicant is for example also aware of U.S. Pat. No. 5,178,492 which issued to Meheen for A Method and Apparatus for Anchoring Backfilled Wall Structures in which is taught the use of a plurality of elements which may be used as either retaining wall panels or tie-backs, each element having a neck at either end, the neck having opposing concave surfaces for mating with the convex surface of each end of an adjacent element.

Other prior art of which applicant is aware is listed in an Information Disclosure Statement filed herewith and incorporated by way of reference. None of the prior art of which applicant is aware teaches or suggests the advantages of the use of the interlocking I-profile blocks according to the present invention as better described below.

SUMMARY OF THE INVENTION

In summary, the modular wall or fence construction system according to the present invention for construction of walls, fences, buildings, etc., includes at least first and second I-profile blocks, each having an I-shape in planform in the sense that four corners, each having a rib-key, are held rigidly apart as the corners of a virtual quadrilateral by the waisted framework of an I or X profile block, or a combination of such shapes. As used herein such waisted profiles are collectively referred to as I-profile blocks or as blocks having an I-shape. The I-shape may be defined by a parallel pair of flanges across opposite ends of a web extending between the flanges. The I-profile blocks have generally planar and parallel upper and lower surfaces and a uniform vertical height. The flanges may form a parallelogram relative to the web, that is, they may be angularly offset relative to the web or may be orthogonal to the web or at least a vertical plane of symmetry of the web where the web is other than planar, for example where the combination of web and flanges is "))("-shaped or "I"-shaped, or "X"-shaped, or "H"-shaped.

Each of the flanges of the first and second I-profile blocks have radiused rib keys formed in opposite parallel edges of the flanges. The edges are distal on the flanges relative to the web. A first pair of the radiused rib keys are a pair of convex rails along the parallel edges on a first side of the web. A second pair of the radiused rib keys are a pair of concave channels along the parallel edges on a second side of the web opposite the first side of the web. Each flange has oppositely disposed, on opposite edges, one convex rail and one concave channel. The web of the first I-profile blocks may advantageously be longer than the web of the second I-profile blocks. The flanges of the first I-profile blocks may, advantageously, be substantially identical. On the second I-profile blocks one of the flanges may be a wider flange wider than the other flange; the narrower flange. Thus, the radiused rib keys for the wider flange are spaced laterally further apart than the radiused rib keys for the narrower flange. In one aspect of the invention the I-profile might be changed to a T-profile, that is, a profile having a web and a single flange, so that the profile only has one pair of concave and convex rib-keys.

An adjacent pair of the first and second I-profile blocks may be interlocked to form a rotatable joint. The joint is rotatable in one degree of freedom during construction of the wall or fence by cupped mating of one convex rail of one of the adjacent pair of I-profile blocks with a corresponding concave channel of the other of the adjacent pair of I-profile blocks.

The webs of the first and second I-profile blocks may include a longitudinally spaced apart array of parallel bores extending vertically into the web for receiving elongate locking pegs snugly journalled therein so as to leave one end of the pegs protruding from the bore. The bores may extend through the entire height of the longitudinal webs. The arrays may lie in a vertical plane of symmetry of the blocks. At least one lateral bore may extend laterally through the webs.

The pair of flanges on each I-profile block may have oppositely disposed finished outer surfaces, generally orthogonal to the webs, so that each of the I-profile blocks may be reversed end-for-end and still project a finished outer surface outwardly of a finished side of the wall or fence being constructed.

The system of the present invention may further include a corner block having, when viewed in planform, at least three spaced apart corners forming therebetween generally a right triangle. Again, the block may have a uniform vertical height. The corners are advantageously formed as three parallel the radiused rib keys. The s three the radiused rib keys may include a vertically and oppositely disposed concave channel and first convex rail pair at two of the three corners, and a second convex rail at a third of the three corners. The corner blocks may be generally rectangular and define an open core extending vertically therethrough. The open core may be partly solidly filled by a solid portion adjacent one of the three corners. At least one array of spaced apart holes may be formed vertically in the solid portion for receiving locking pegs snugly mounted therein.

BRIEF DESCRIPTION OF THE DRAWINGS

FIG. 12 is, in plan view, a adjacent linear array of first and second I-profile blocks and first and second corner blocks so as to form a row in a wall.

FIG. 13 is, in plan view, an end-to-end array of cover blocks according to the present invention.

DETAILED DESCRIPTION OF EMBODIMENTS OF THE INVENTION

Figure 1:
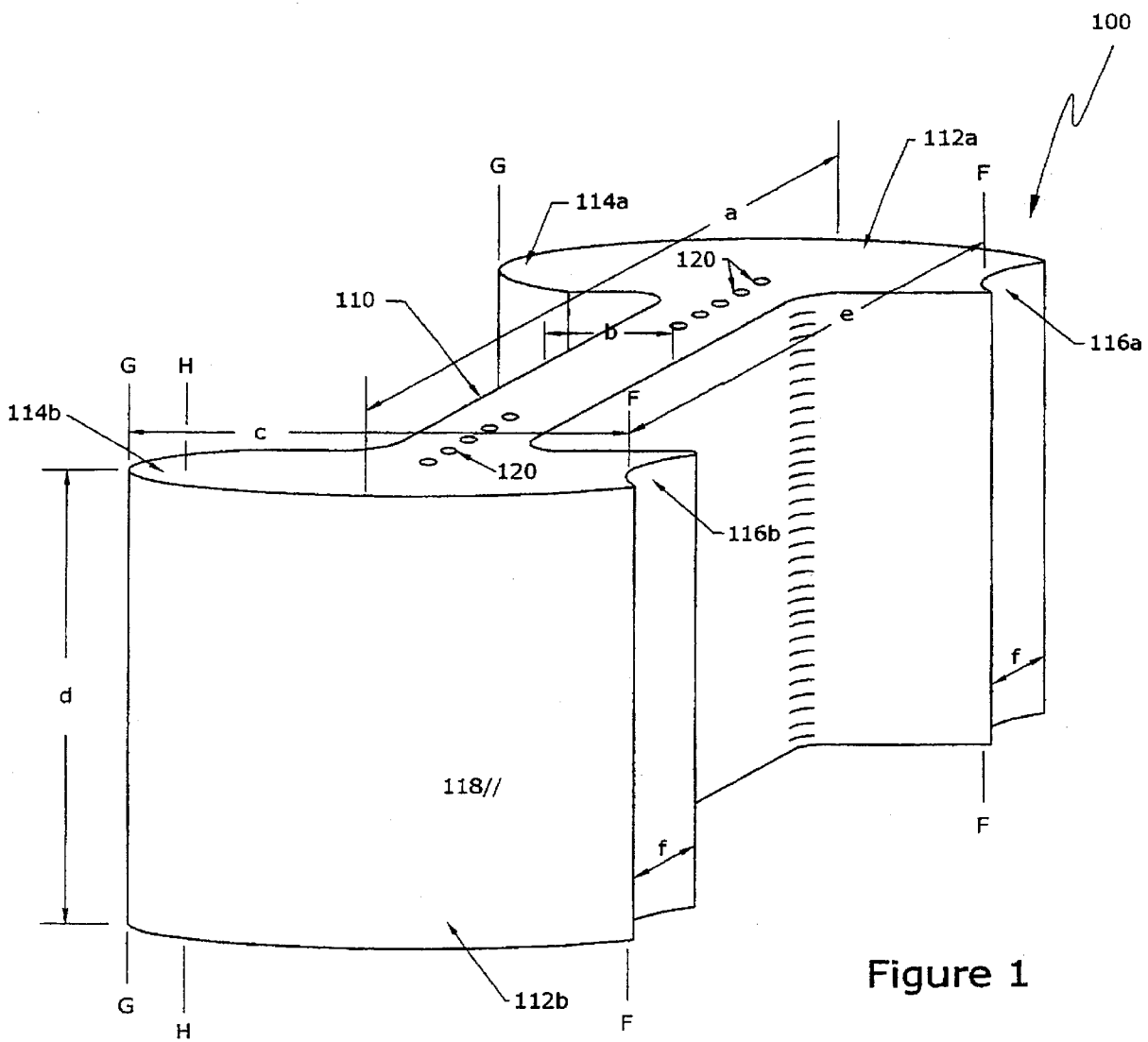
FIG. 1 is, in perspective view, a first I-profile block according to the present invention.
Figure 2:
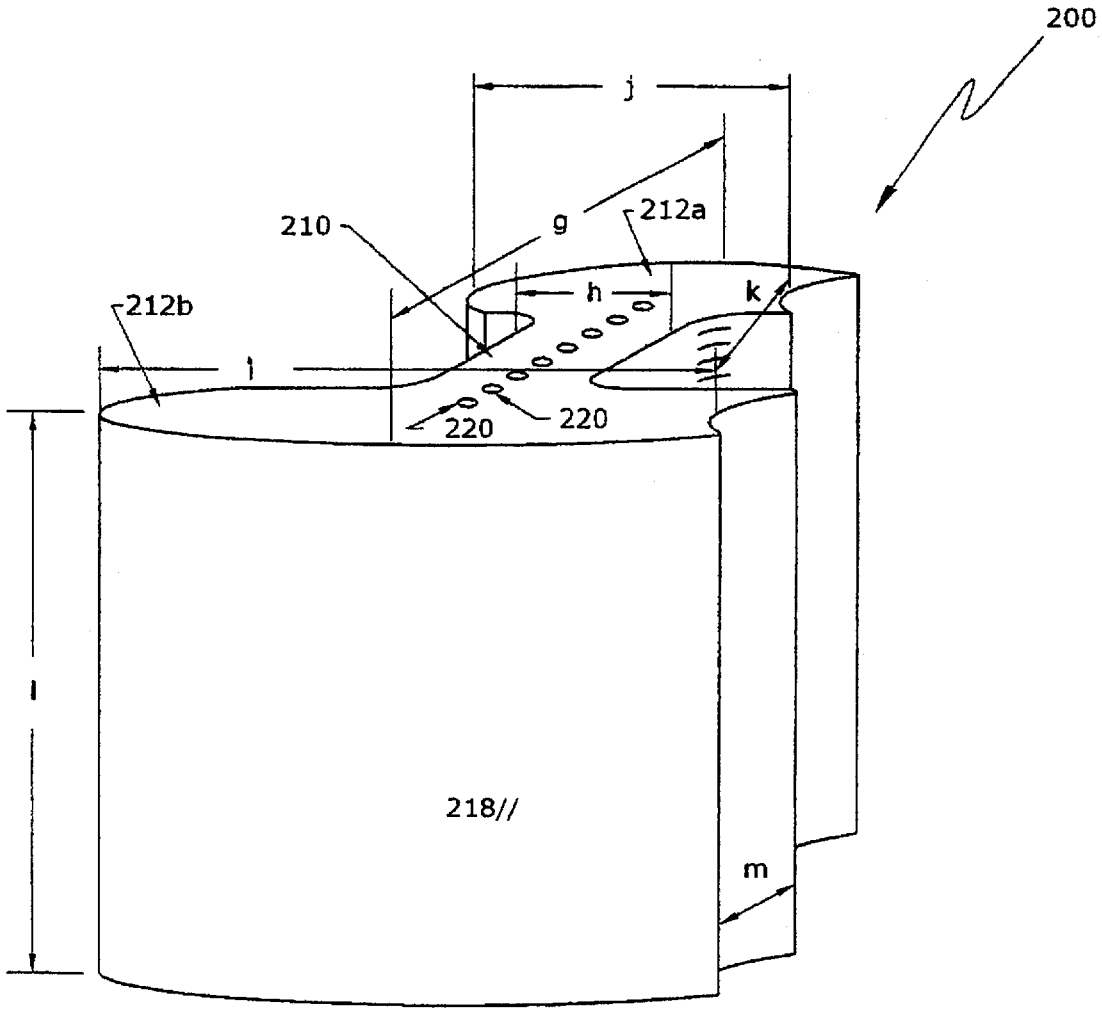
FIG. 2 is, in perspective view, a second I-profile block according to the present invention.
Figure 2A:
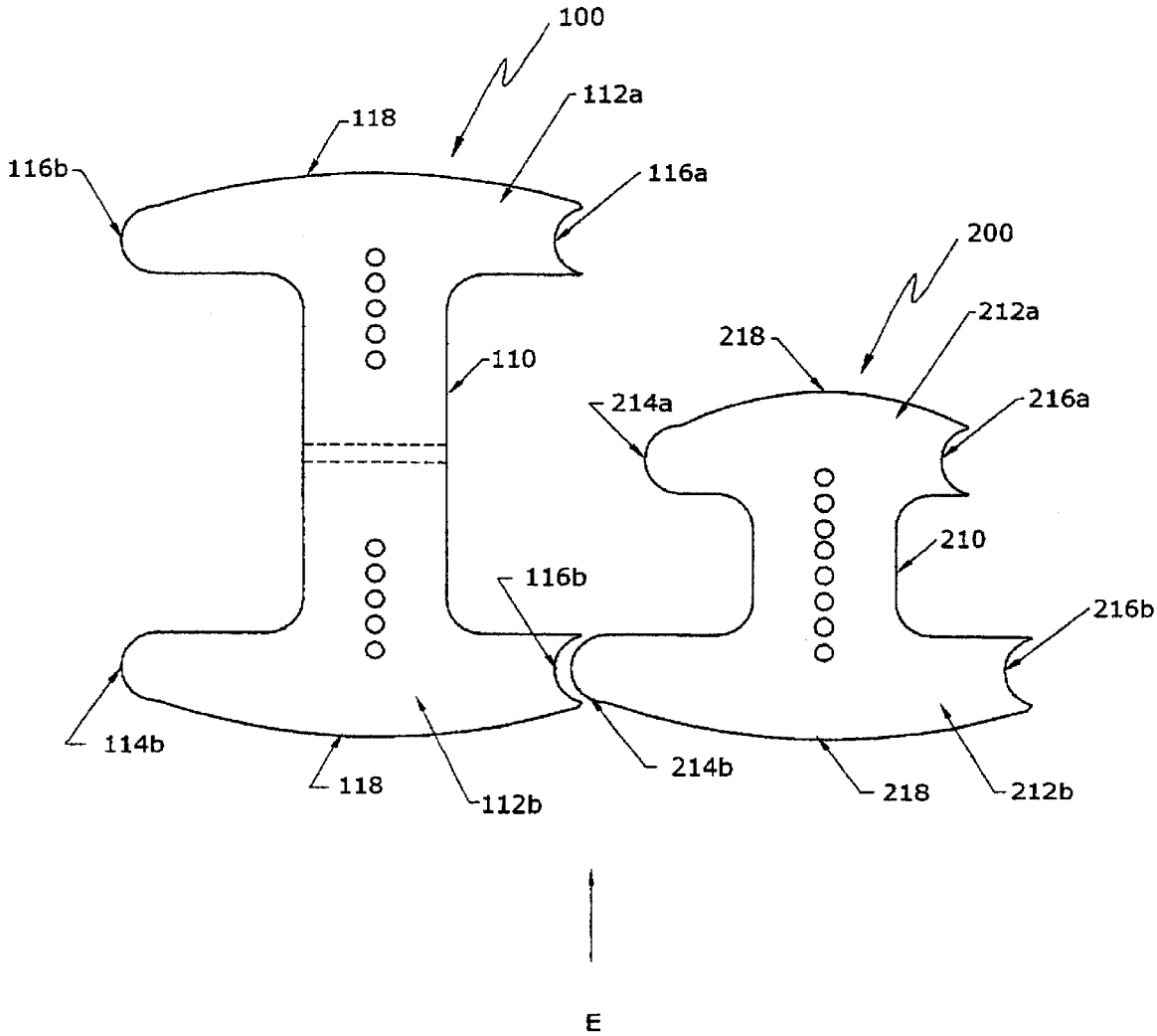
FIG. 2*a* is, in plan view, a pair of first and second I-profile blocks according to the present invention in interlocking adjacent mating engagement.

The modular building block system according to the present invention includes building blocks have two basic profiles, namely, a first profile in the shape of an "I" for use in constructing the length of a wall or fence, and second basic profile in the shape of what may be generally characterized as a rectangle for use in forming spacers or corners between adjoining walls or fences. Within the general classes of these first and second profiles, and without intending to be limiting, within the class of first profiles, that is, the "I" shaped profiles, are the large and small I-blocks 100 and 200 as respectively depicted in FIGS. 1 and 2. The general class of second profile, that is, the generally rectangular profiles, are depicted as large and small corner blocks 300 and 400 respectively in FIGS. 3 and 4.

Figure 1A:
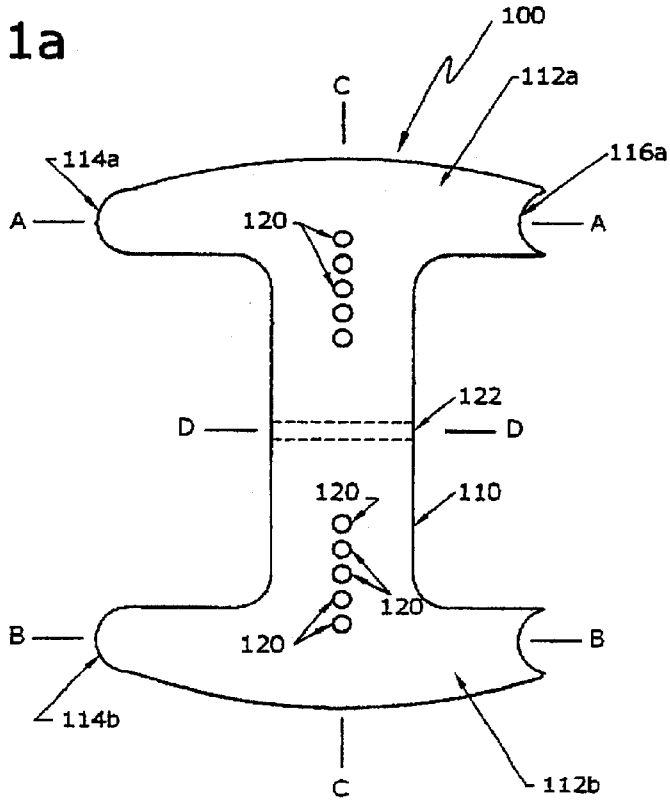
FIG. 1*a* is, in plan view, the I-profile block of FIG. 1.

As better seen in FIGS. 1*a*–1*c*, and FIG. 2*a*, I-shaped blocks 100 and 200 include a backbone or beam web 110 and 210 respectively interconnecting rigid flanges 112*a* and 112*b* on I-shaped block 100 and flanges 212*a* and 212*b* on I-shaped block 200. Flanges 112*a* and 112*b* are generally parallel and lie in a parallel pair of first and second planes which are orthogonal to the plane containing web 110. Similarly, flanges 212*a* and 212*b* are also parallel and lie generally in first and second planes which are parallel and orthogonal to a third plane containing web 210. The flanges are symmetric about a fourth plane which is also parallel to the planes containing the flanges and which is also orthogonal to the third plane containing the webs. In FIG. 1*a*, the first, second, third and fourth planes are understood as being orthogonal to a fifth plane containing the page of the illustration. This fifth plane contains the longitudinal axes A and B of the flanges, the longitudinal axis of the web, and the transverse axis of the web.

As may be seen, each of the flanges 112*a*, 112*b*, 212*a*, and 212*b* are symmetric about their respective longitudinal axes but are not symmetric about the longitudinal axis of the web. This is because the opposite ends or edges of the flanges distal from the web are formed so that one end is concave and the other end formed as correspondingly convex. Thus as again illustrated by way of example in FIG. 1*a*, flange 112*a* includes concave end or rail 114*a* and, at the opposite end of the flange, convex end or channel 116*a*. Similarly, flange 112*b* has a concave end or rail 114*b* and an opposite convex end or channel 116*b*. Likewise, on I-shaped block 200, flange 212*a* has a concave rail 214*a* and an opposite convex channel 216*a*, and, on flange 212*b*, a concave rail 214*b* and an opposite convex channel 216*b*. The concave and convex ends of the flanges provide for interlocking between adjacent I-shaped blocks whether they be I-shaped blocks 100 or I-shaped blocks 200, for example as seen in the interlocking mating of the blocks in FIG. 2*a*, so as to present a contiguous interlocked row. Each row presents a finished outer surface when viewed in direction E. Each row may then form the basis upon which further rows may be built, as better hereinafter explained, to form gravity retaining walls, fences for sound and privacy, and so as to provide for erosion control.

Figure 1B:
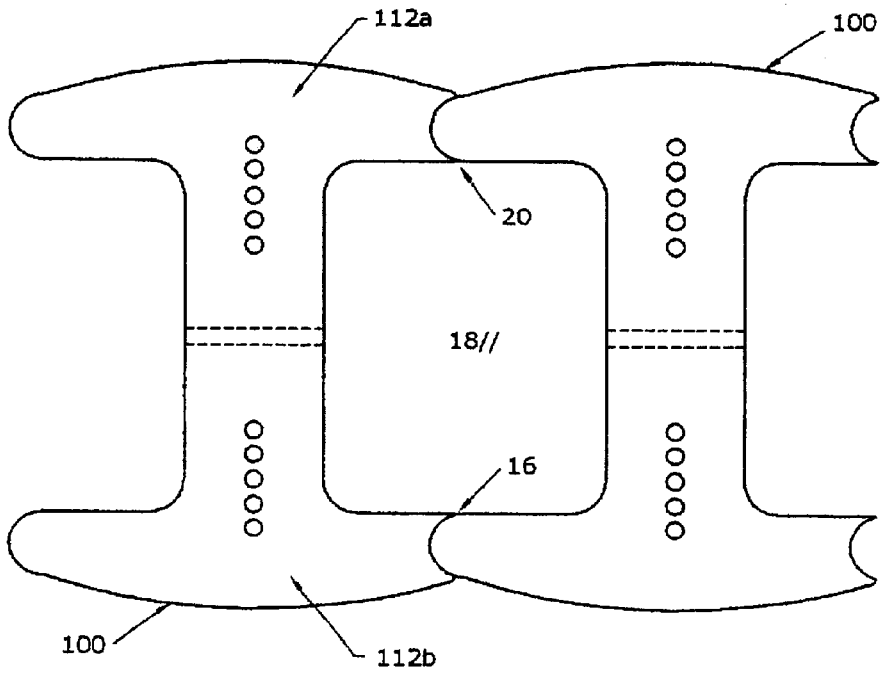
FIG. 1*b* is, in plan view, two I-profile blocks according to FIG. 1 in adjacent interlocking engagement in a first row.
Figure 1C:
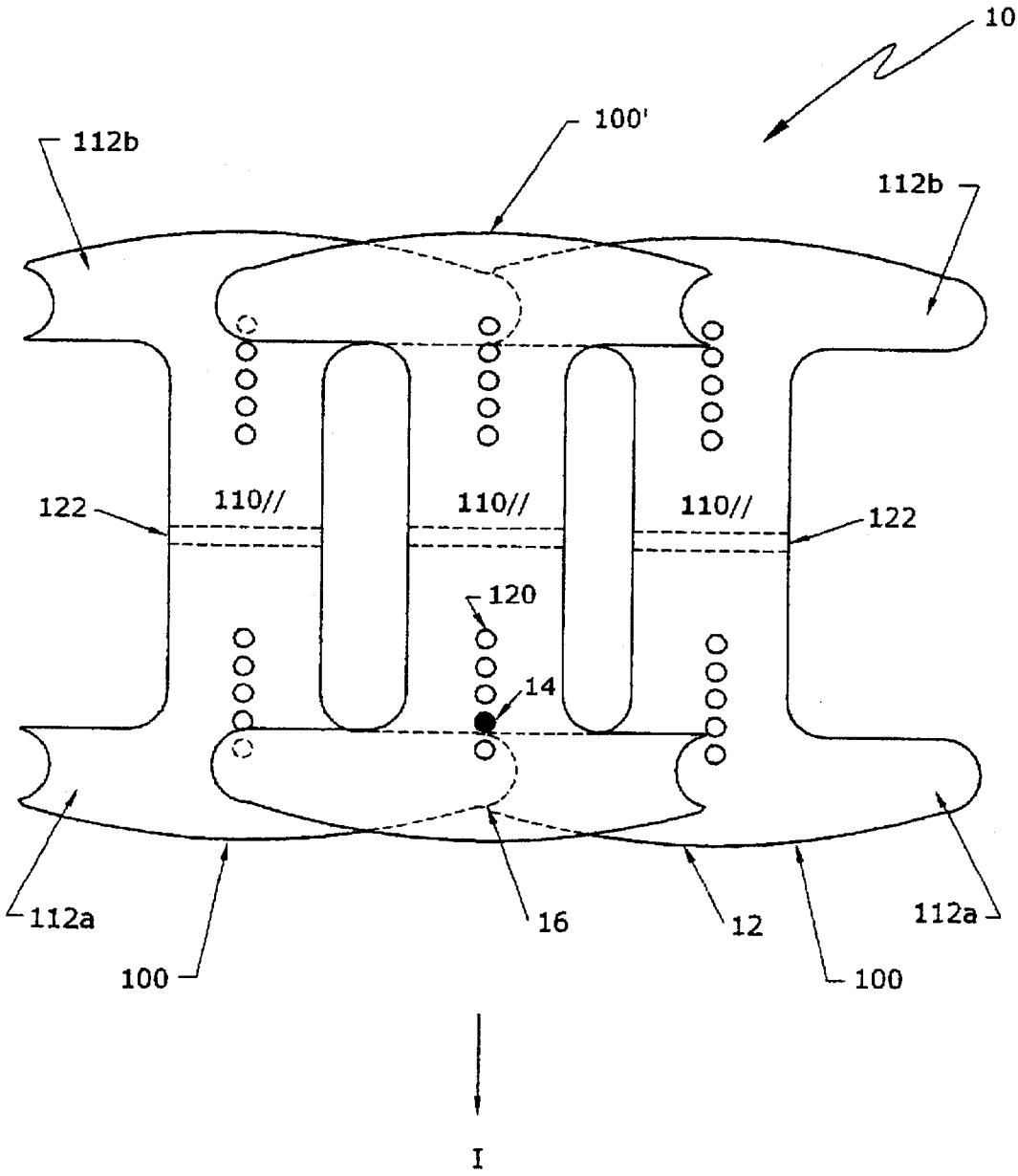
FIG. 1*c* is the first row of FIG. 1*b* with a third I-profile block according to FIG. 1 mounted thereon in a second adjacent row on top of the first row of FIG. 1*b*.
Figure 5:
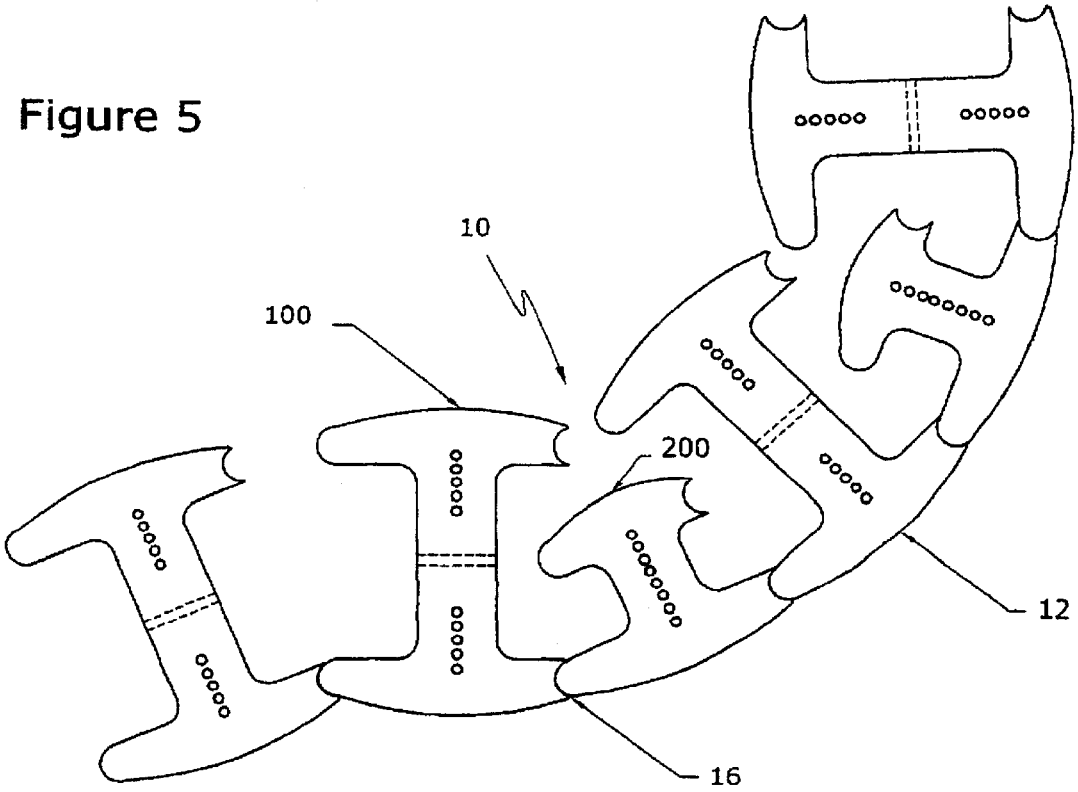
FIG. 5 is, in plan view, an adjacently mated array of first and second I-profile blocks forming a radiused construction.

Thus one of the advantages of using the I-shape as the profile of the I-shaped blocks is that the outermost surfaces of the flanges, outermost surfaces 118 on block 100 and outermost surfaces 218 on block 200, may be aesthetically or otherwise architecturally finished, for example by the gentle concave curvatures depicted although this is not intended to be limiting. Thus, because both ends of the I-shaped profile, that is outer surfaces 118 and 218 are aesthetically pleasing or otherwise architecturally finished, the blocks may be reversed end-for-end when installed so as to expose either end of the I-shaped profile as the finished wall, that is, the exterior surface which may be seen when viewed in direction E. It is advantageous that the I-shaped blocks be reversible because flanges 212*a* and 212*b* on block 200 are of different widths when measured along axis A and B respectively so as to provide for curves or turns in an assembled wall or fence construction as better seen in FIG. 5. It is to be understood however that blocks 100 alone may be used to construct a linear wall or fence such as seen in FIG. 1*b* and 1*c*, and similarly that blocks 200 alone may also be used to construct a wall or fence, although not necessarily linear because of the different flange widths. Thus, for example, in the embodiment wherein blocks 100 are of larger dimensions than the corresponding dimensions in blocks 200, then blocks 100 may be advantageously employed to construct a large wall or fence and the smaller blocks 200 may be used to construct a relatively smaller wall or fence, with the commensurate lower costs.

Thus by way of illustration and not intending to be limiting, in FIG. 1 the length a of web 110 may be sixteen and one half inches and the width b may be four inches. The width c of both flanges 112*a* and 112*b* may be twelve inches and the uniform height d of the block may be eight inches. Dimension e, being the distance between the axes F of the vertices of concavities 116*a* and 116*b*, may be twelve and one half inches. The distance between the axes G, being the vertices of convexities 114*a* and 114*b*, may be the same dimension as dimension e. Convexities 116*a* and 116*b* may have diameters f measuring two inches. The corresponding dimensions of a block 200 may be a web length g of ten inches, a web width h of three and one half inches, a large flange 212*b* width i of eleven inches, a small flange 212*a* width j of seven and one half inches, a dimension k between vertices of the convexities 216*a* and 216*b* of six inches, and, as with block 100, a uniform height I of eight inches and a convexity diameter m of two inches.

Because the convexities are semi-circular in cross-section, and because concavities 114*a* and 114*b* are also semi-circular in cross-section and sized to snugly mate into convexities 116*a* and 116*b*, and because convexities 216*a* and 216*b* and concavities 214*a* and 214*b* on blocks 200 are of the same shape and size as their counterparts on blocks 100, the concavities of either blocks 100 or 200 may be mated with the convexities of either blocks 100 or 200 form a interlocking joint which, as the wall or fence is constructed, may be rotated so as to set adjacent blocks in any particular row in desired angular orientations relative to one another permitting the forming of both outside and inside curves along the outer surface 12 of wall 10. Thus in the embodiment where the concavities and convexities are semi-circular in plan view cross-section, the joint at interlocking concavities and convexities between adjacent blocks may be rotated about an axis of rotation which coincides with for example the center of curvature H of the convexity 114*b*.

Webs 110 and 210 may each have a vertical, parallel, spaced apart array of holes or bores 120 and 220 respectively. Holes 120 and 220 may be of one half inch diameter and may pass through the entire height of the web so that locking pegs 14 such as seen in FIG. 1*c* may be inserted to one of the array of holes in the underside of blocks 100 and 200 thereby allowing a block 100' in an upper row of wall 10 to be locked to blocks 100 in an adjacent lower row so as to resist shearing movement of block 100' in direction I relative to blocks 100 in the lower row. Locking pin 14 may be snugly locked in the intersection between flanges 112*a* at joint 16. The use of holes 120 in blocks 100 and holes 220 in blocks 200, which may also be used with pegs 14 allows a wall configuration to be built having an adjustable batter or wall setback, depending on the height of the wall, soil conditions etc. as would be known to one skilled in the art. In the prior art, the so called prior art Allan " block design has a fixed lip and requires different blocks for each batter setback, that is, three degree, six degree and twelve degree blocks. Locking pegs 14 may also be inserted into the holes 120 or 220 of the I-profile blocks so as to prevent the holes from becoming plugged with backfill material, a problem encountered in the prior art with the use of so called prior art Keystone" blocks. Locking pegs 14 are free to slide along the inside edges of the flanges of blocks 100 and 200 which provides flexibility so that, contrary to the prior art, locking pegs are not left out, for example in the use of prior art Keystone " blocks, because of the misalignment of the holes between rows.

Laterally extending through-bores 122 may be provided which extend entirely through webs 110 parallel to axis D, for example, coaxial with axis D, or at least so as to be positioned medially along the length of axis C. Bores 122 are sized to receive in journalled engagement therethrough so-called "rebar" reinforcing rods (not shown) which are inserted into the wall or fence, so as to run with the wall or fence parallel to outer surface 12 for use in cases where a concrete reinforced wall is required.

In the linear or straight walls of FIGS. 1*b* and 1*c*, the interlocking mating of blocks 100 so that the convexities 114*a* and 114*b* on a first block mate with the corresponding convexities 116*a* and 116*b* on a next adjacent block, define therebetween an open core 18 which may be filled with compacted granular fill so as to provide improved drainage. The interlocking nature of joints 16 and 20 allow adjacent blocks to slightly move apart without breaking during freeze-thaw cycles. This is to be compared to the so called prior art Terra Force" blocks which have a fixed core design with no outward means of pressure release. In the present invention, the open cores 18 are defined by the modular construction of the wall so that granular core fill material may be added after placement of the blocks to complete the weight necessary for soil retention. The use of fill material in the open cores also improves the sheer resistance between each I-profile block, that is, between adjacent blocks, as compared to the use of solid core blocks.

As mentioned above, and as better seen in FIG. 5, walls 10 may be curved so as to construct convex, concave or sinuously curved or for example sinusoidally curved walls by the use of combinations of blocks 100 and 200. As may be seen, the curvature is accommodated by the radiused rib key interlocking rotatable joint between adjacent blocks provided for by the use of the concavities and convexities on the block flanges. By the use of the blocks 200, the smaller flanges 212*a* may be nested within the channels formed between flanges 112*a* and 112*b* on blocks 100 thereby allowing for tighter curvature of outer surface 12, the interlocking of concavities and convexities at joints 16 providing for a more fluid appearance to the wall curvature, all of which accomplished without having to cut blocks with a masonry saw or the knocking off of pieces of blocks as would be the case in the prior art for example with the use of so called Allan" blocks. Thus tighter wall curvatures are obtained by the use of the smaller flange ends on the smaller I-profile blocks 200 providing the necessary reduction in the required wall curvature radius. The wall then constructed according to the present invention provides for an increased flexibility in varying the batter or wall setback and for the flowing curvature of the wall without altering of the blocks, and only relying on interlocking using the radiused rib keys, for example in combination with the locking pegs and compacted granular fill.

Figure 6:
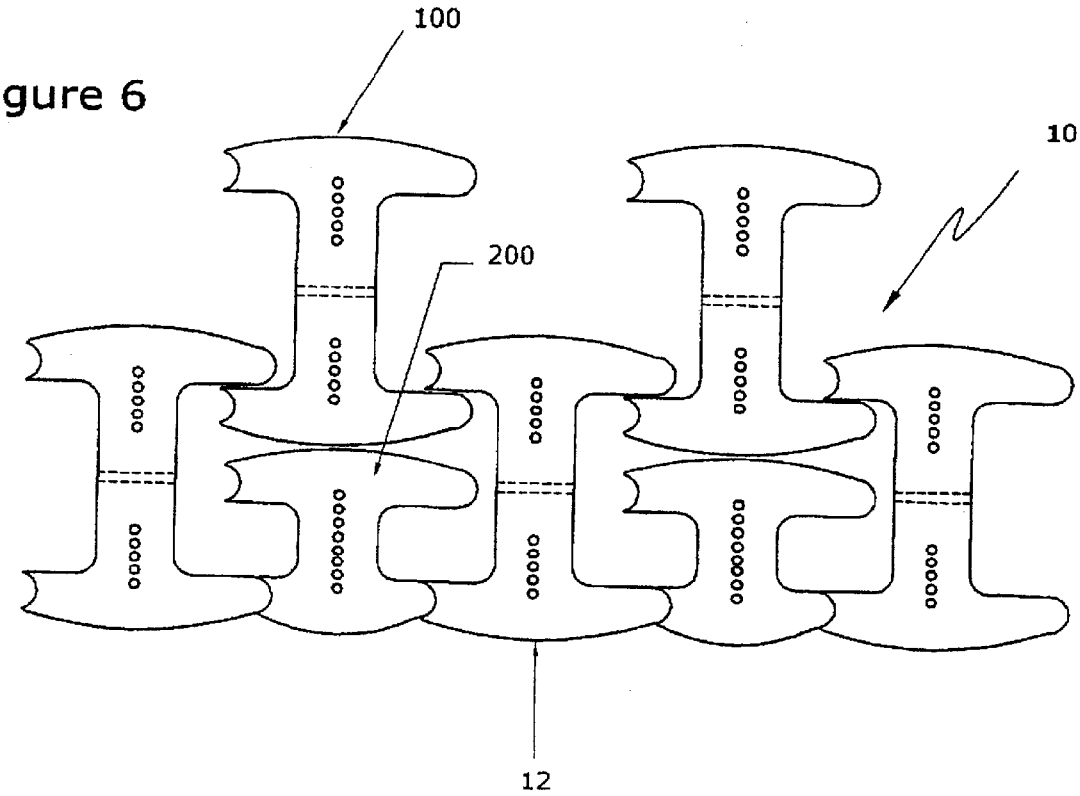
FIG. 6 is, in plan view, a further array of adjacently interlocking first and second I-profile blocks.

As better seen in FIG. 6, I-profile blocks 100 and 200 may be locked together in depth so as to extend a wall further back into a slope thereby providing deeper penetration and raising the capacity of the wall to be built higher without the use of geotextile reinforcement as would be used in prior art retaining systems. The use of the system according to the present invention allows for the tailoring of a wall's retaining ability, for example, so as to reduce the degree of retaining ability of a wall as one goes higher up the wall by the use of larger I-profile pieces towards the bottom of the wall and smaller I-profile pieces towards the top of the wall thereby potentially reducing the cost of construction, again achieved by the use of a single generic I-profile and two sizes of blocks.

Figure 7:
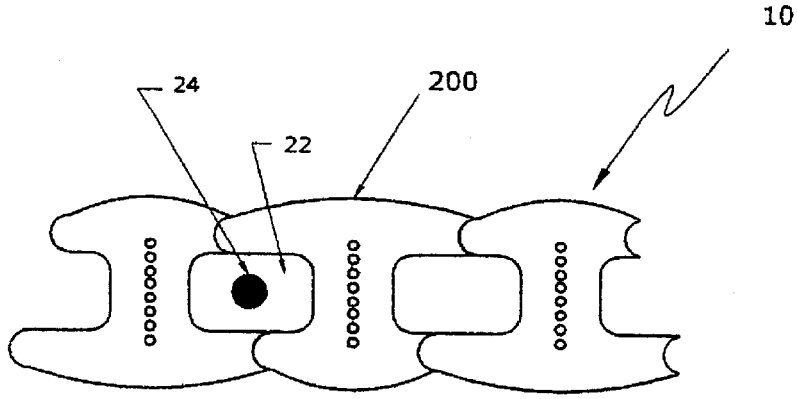
FIG. 7 is a linear array of second I-profile blocks for construction of a fence.

As better seen in FIG. 7, the use of I-profile blocks according to the present invention allows the use of a fence for improved sound attenuation and or privacy while still maintaining an aesthetically pleasing appearance on both sides of the wall due to the finished ends 118 and 218. In the example of FIG. 7 which is not intended to be limiting, blocks 200 are employed by reversing adjacent blocks so as to interlock the radiused rib keys and thereby define open cores 22 which are aligned vertically between rows so that reinforcing steel 24 and concrete may be inserted into vertically aligned cores 22 at intervals along the wall to thereby eliminate or reduce the need for stabilizing posts as would be used in the prior art.

Figure 8:
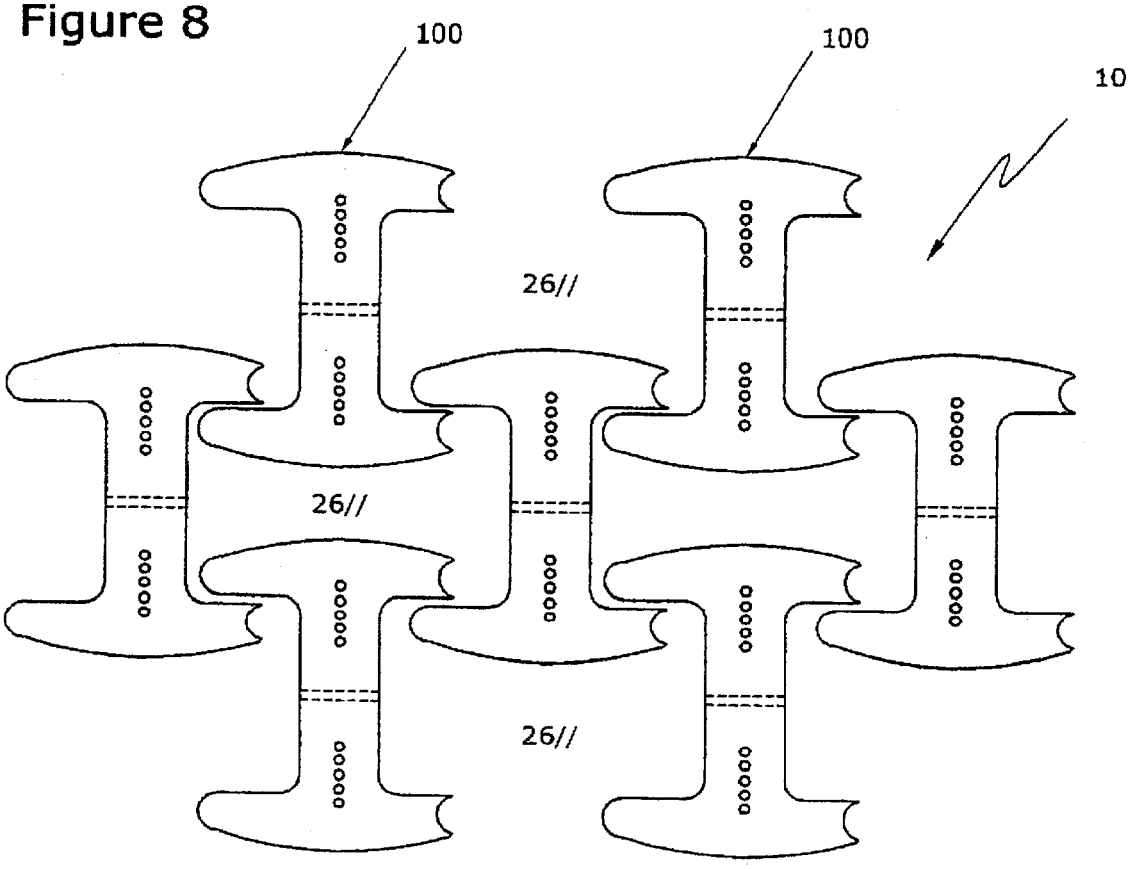
FIG. 8 is, in plan view, a further interlocking array of first I-profile blocks for supporting loading when inset into soft terrain.

FIG. 8 illustrates by way of example the use of a planform array of I-profile blocks 100 so as to provide for load bearing in soft, for example grassy areas, where loads are applied by heavy vehicle or aircraft traffic for example. The interstitial spaces 26 provide exposed soil patches for maintaining grass or vegetation. This arrangement may also be used to control erosion for example on beaches or river banks.

Figure 9:
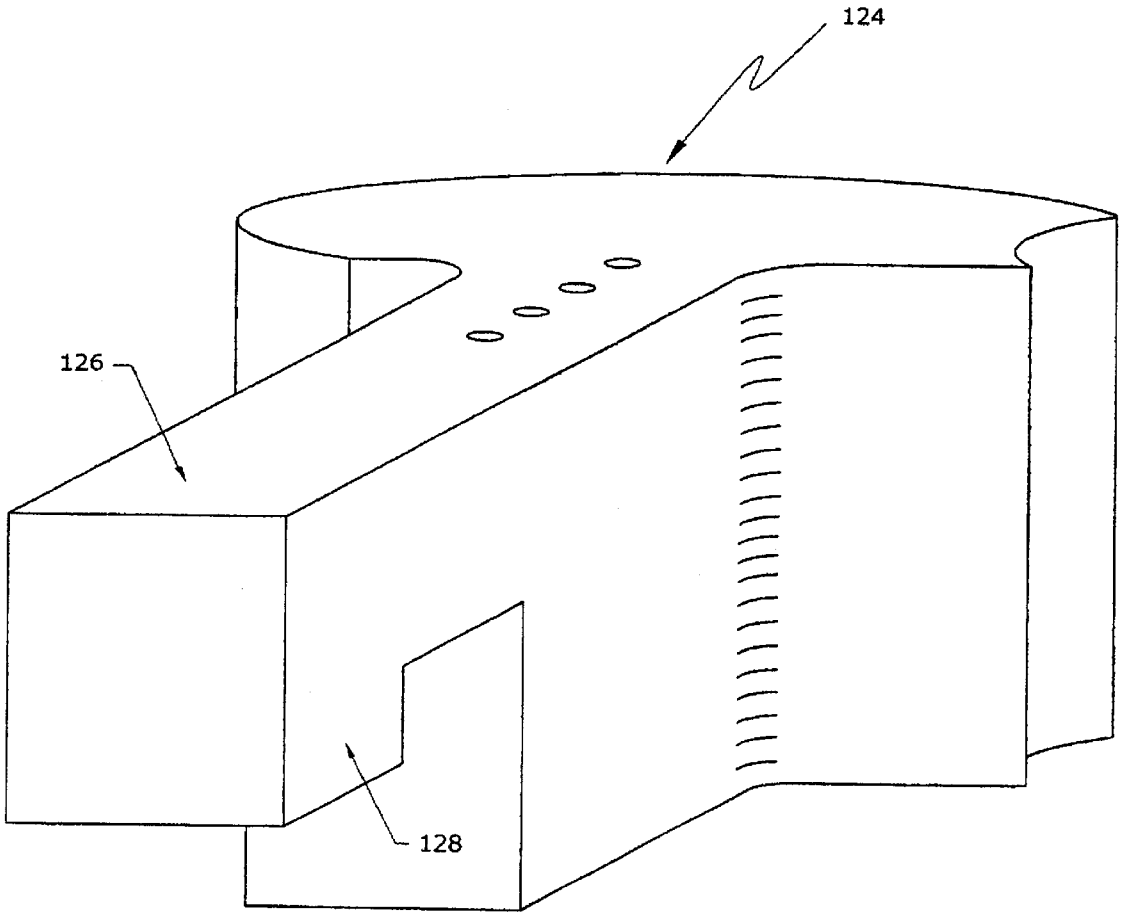
FIG. 9 is, in perspective view, one half block for the modular construction of an I-profile block.
Figure 9A:
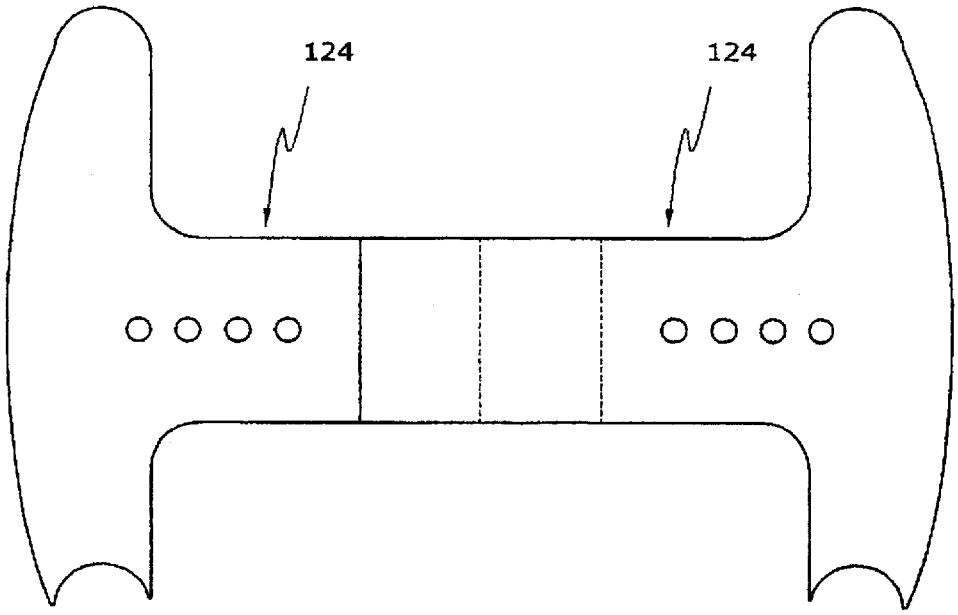
FIG. 9*a* is, in plan view, two of the half blocks of FIG. 9 assembled to form an I-profile block.
Figure 9B:
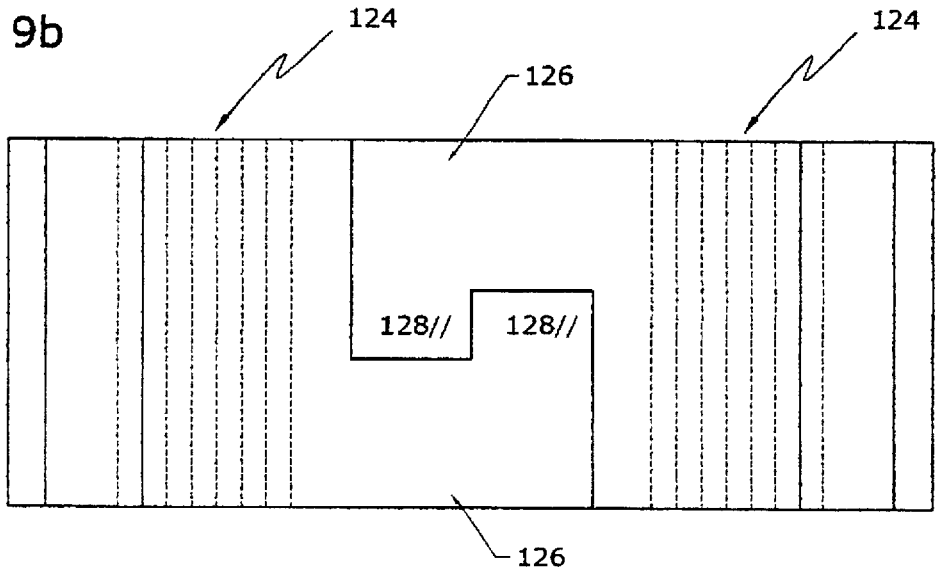
FIG. 9*b* is, in side elevation view, the assembled I-profile block of FIG. 9*a*.

As seen in FIGS. 9, 9*a* and 9*b*, the I-profile blocks, for example blocks 100, may be each assembled by the modular interlocking of half blocks 124. A pair of half blocks 124 may be hooked together by inverting one of the half blocks so that a first web section 126 forms a downward facing hook 128 for interlocking with an adjacent upwardly turned hook 128 on an adjacent web section 126 in the pair of half blocks 124. The assembled whole provides the equivalent of a block 100. The use of half blocks 124 facilitates producing larger individual pieces which may be locked together for the production of larger walls, where each half may still be of a manageable size thereby reducing potentially the need for heavy equipment.

Figure 3:
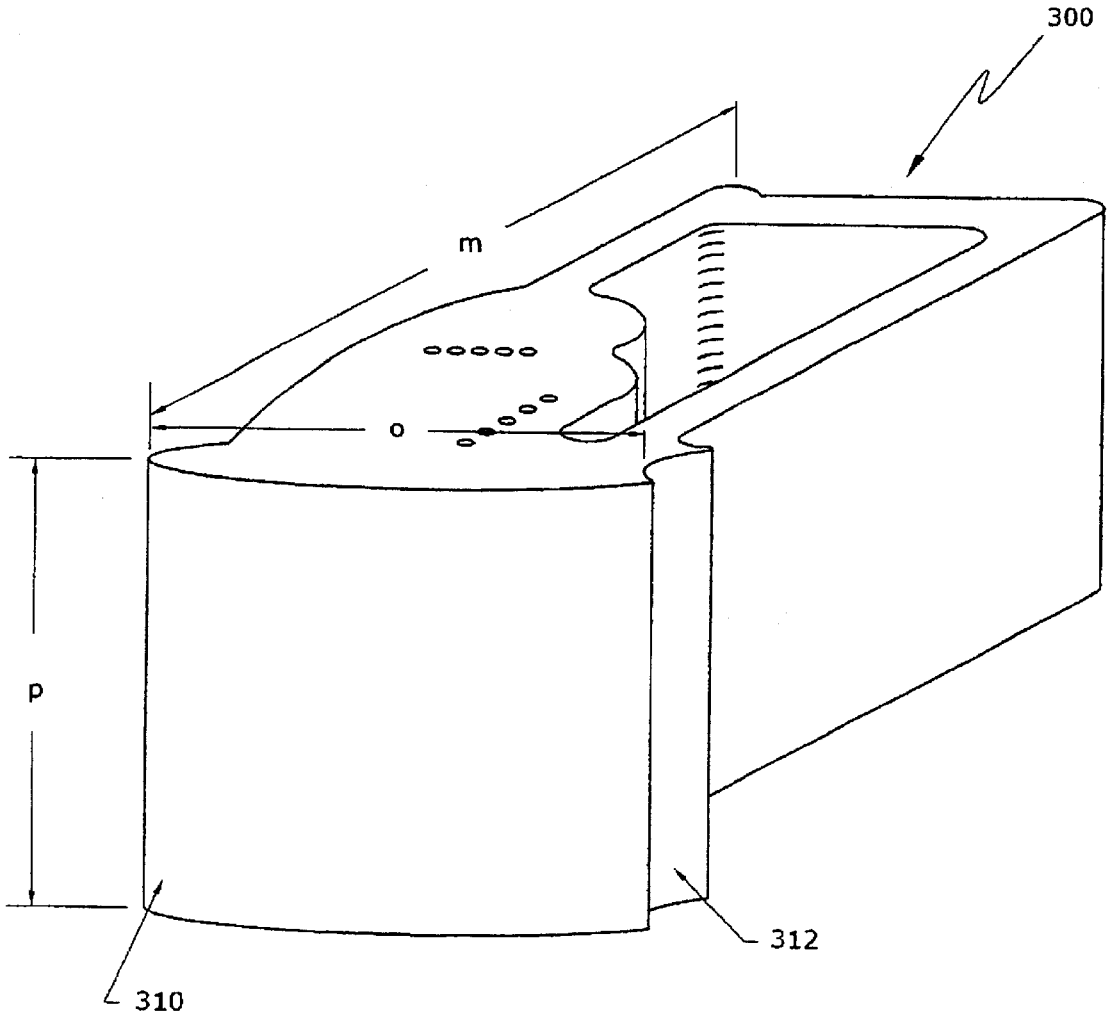
FIG. 3 is, in perspective view, a first corner block according to the present invention.
Figure 4:
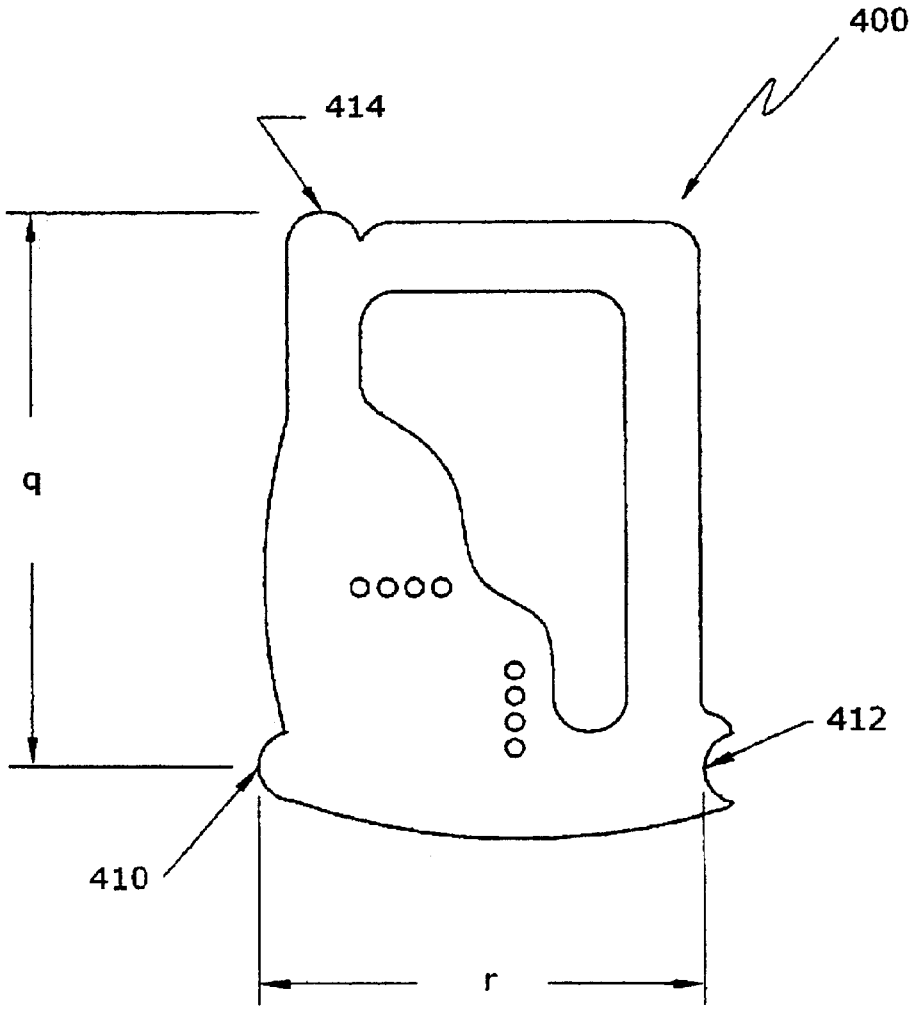
FIG. 4 is, in plan view, a second corner block according to the present invention.
Figure 10:
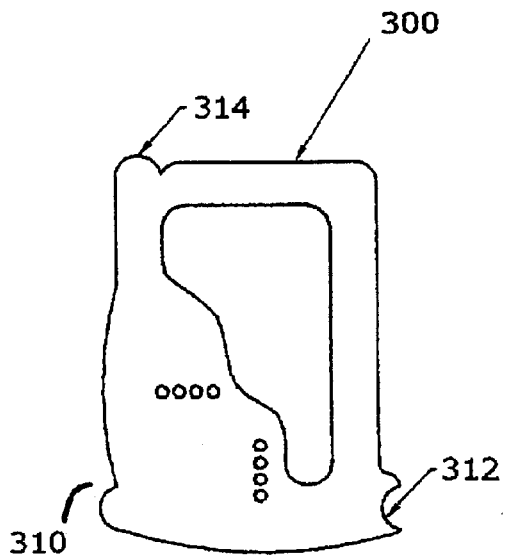
FIG. 10 is, in plan view, the corner block of FIG. 3.
Figure 11:
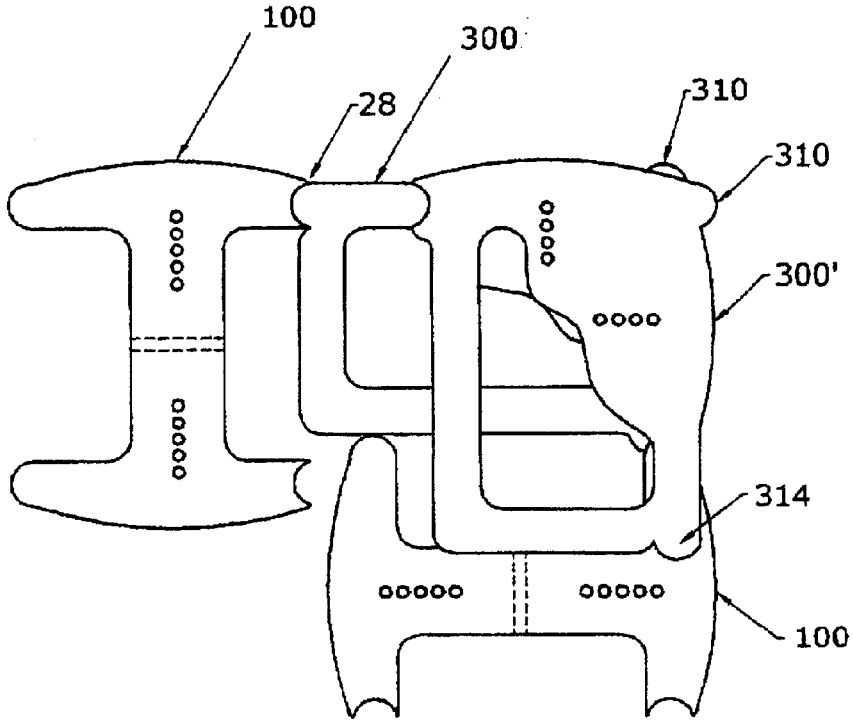
FIG. 11 is, in plan view, a corner construction of first I-profile blocks adjacent the corner block of FIG. 10 in a first lower row, and a second corner block of FIG. 10 assembled in an overlaying second row.

The second generic profile block according to the present invention is depicted in FIGS. 3, 4 and 10, and features prominently in the construction of FIGS. 11 and 12. These blocks are referred to for ease of reference herein as corner blocks 300 and 400. They are substantially the same in shape, however, their dimensions differ. Thus in FIG. 3, dimension n, which is the length of the generally rectangular block, may be eighteen and one quarter inches. The width o of the block at the radiused rib key end may be thirteen inches, and again, the block may have a uniform height p of eight inches. With respect to the corner piece 400, the length to the vertice of the concavity 410 may be ten and one half inches, and the width of the corner piece extending between the vertice of concavity 410 and the vertice of convexity 412 may be seven inches. In FIG. 4, those dimensions are labelled as q and r respectively. The corresponding concavity and convexity on block 300 are labelled for reference as concavity 310 and convexity 312. Both corner pieces 300 and 400 also include a third radiused rib key interlocking rail, namely, convexities 314 and 414 respectively.

Thus, a block such as corner pieces 300 and 400 may be used to form a corner between perpendicular intersecting walls by, for example, mating convexity 314 with a concavity 116*a* on an adjacent block 100, so as to interlock at joint 28 as seen in FIG. 11. A second corner piece 300' may be overlaid in the row immediately above corner piece 300. Piece 300' may be rotated ninety degrees from the orientation of corner piece 300. This is simply achieved by laying a first corner piece in the lower row and taking a second corner piece and inverting it for use in the next row above. Comer pieces 300 and 400 may also be used as a spacer or make up piece in a wall to switch or alter the lead and lag of the connections between the pieces, that is, a half piece such as seen in use in FIG. 12. There, a row in a wall includes the use not only of I-profile blocks 100 and 200, but also corner piece blocks 300 and 400 used as make up pieces between the I-profile blocks. As seen in FIG. 12, the row of various blocks according to the present invention are altered so as to vary lead and lag so the locking radiused rib keys do not align to thereby keep the wall stronger. In the prior art of which applicant is aware there is no provision to construct and adjust the lead and lag in the wall thereby making for weaker walls and often requiring numerous masonry cuts to keep joint lines staggered. In the present invention, the system compensates for a radius change as each row of the wall steps back by simply using a slightly smaller or slightly larger flange width. The larger the batter or wall setback, the more necessary this becomes.

Figure 14:
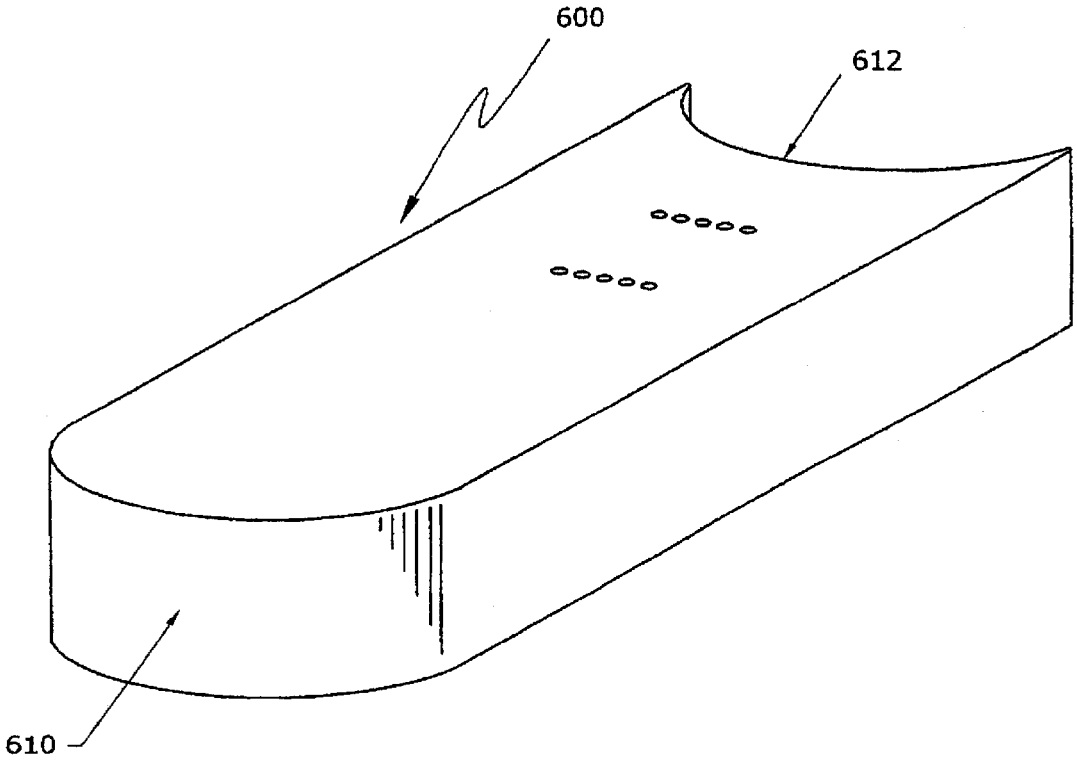
FIG. 14 is, in perspective view, one of the cover blocks of FIG. 13.

FIG. 13 illustrates an optional cap block having one rounded end and an opposite correspondingly concave opposite end. Thus as seen in FIGS. 13 and 14, cap block 600 has one semi-circular rounded end 610 and an opposite semi-circular convex end 612. Cap block 600 may in one embodiment be twelve inches long as measured between the vertices of ends 610 and 612, may be six inches wide and three inches thick. Thus a continuous line of cap blocks 600 may be interlocked end-to-end with adjacent cap blocks rotated at joints 30 relative to one another so that the line of cap blocks may follow the curve of a wall 10 when the cap blocks are installed on top of the wall without the need for masonry cutting. Each cap block may have series or arrays of holes 114, again for the mounting therein of locking pegs so that the cap blocks may be locked into the blocks in the wall below. Cap blocks 600 when placed one behind another may also serve as a cap for a fence constructed of the blocks according to the present invention.

As described herein, the dimensions are by way of example only as they are not necessarily fixed. The sizes of the blocks may depend on the manufacturing machines used, that is, for example wet cast versus dry cast, as well as the ability of the manufacturing machines to produce such large or small pieces. With respect to FIG. 9 in particular, the interlocking half block system portrayed, may be manufactured in any size, for example eight inches high or two feet high and in appropriate widths.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A modular wall or fence construction system comprising:

at least first and second I-profile blocks, said first and second I-profile blocks each having an I-shape in planform so as to define a parallel pair of flanges across opposite ends of a web extending between said flanges, said I-profile blocks having generally planar and parallel upper and lower surfaces and a uniform vertical height, wherein each of said flanges of said first and second I-profile blocks have radiused rib keys formed in opposite parallel edges of said flanges, said edges distal on said flanges from said web, a first pair of said radiused rib keys being a pair of convex rails along said parallel edges on a first side of said web and a second pair of said radiused rib keys being a pair of concave channels along said parallel edges on a second side of said web opposite said first side of said web so that each flange of said pair of flanges has oppositely disposed on opposite said edges one convex rail of said pair of convex rails and one concave channel of said pair of concave channels, wherein an adjacent pair of said first and second I-profile blocks may be interlocked to form a rotatable joint, rotatable in one degree of freedom during construction of the wall or fence, by cupped mating said one convex rail of one of said adjacent pair of said first and second I-profile blocks with a corresponding said one concave channel of the other of said adjacent pair of said first and second I-profile blocks, wherein said flanges of said first I-profile blocks are substantially identical, and wherein one of said flanges of said second I-profile blocks is a wider flange which is wider than the other narrower flange of said flanges of said second I-profile blocks so that said radiused rib keys for said wider flange are spaced laterally further apart than said radiused rib keys for said narrower flange.

2. The system of claim 1 wherein said webs of said first and second I-profile blocks include a longitudinally spaced apart array of parallel bores extending vertically into said web for receiving elongate locking pegs snugly journalled therein.

3. The system of claim 2 wherein said bores extend through the entire height of said longitudinal webs and wherein said arrays lie in a vertical plane of symmetry of said blocks.

4. The system of claim 2 further comprising at least one lateral bore extending laterally through said webs.

5. The system of claim 2 wherein said pair of flanges have oppositely disposed finished outer surfaces generally orthogonal to said webs so that each of said I-profile blocks may be reversed end-for-end and still project a finished outer surface of said finished outer surfaces outwardly of a finished side of the wall or fence being constructed.

6. The system of claim 1 further comprising a corner block having, when viewed in planform, at least three spaced apart corners forming therebetween generally a right triangle and having said uniform vertical height, said corners formed as three parallel said radiused rib keys.

7. The system of claim 6 wherein said three said radiused rib keys include vertically and oppositely disposed concave channel and first convex rail pair at two of said three corners, and a second convex rail at a third of said three corners.

8. The system of claim 7 wherein said corner blocks are generally rectangular and define an open core extending vertically therethrough.

9. The system of claim 8 wherein said open core is partly solidly filled by a solid portion adjacent one of said three corners and at least one array of spaced apart holes is formed vertically in said solid portion for receiving locking pegs snugly mounted therein.

10. The system of claim 1 wherein said web of said first I-profile blocks is longer than said web of said second I-profile blocks.

* * * * *